United States Patent [19]

Chio

[11] 4,339,281

[45] Jul. 13, 1982

[54] SHANK DIAMOND CLEANING

[75] Inventor: Shiu-Shin Chio, Indianapolis, Ind.

[73] Assignee: RCA Corporation, New York, N.Y.

[21] Appl. No.: 294,736

[22] Filed: Aug. 20, 1981

[51] Int. Cl.[3] ..... B08B 3/08; B08B 3/12

[52] U.S. Cl. ..... 134/1; 134/26; 134/28; 134/29; 134/30; 134/42

[58] Field of Search ..... 134/1, 26, 28, 29, 30, 134/42; 369/71

[56] References Cited

U.S. PATENT DOCUMENTS

| | | | |
|---|---|---|---|
| 2,667,434 | 1/1954 | Strandberg | 134/42 |
| 2,790,738 | 4/1957 | Alexander et al. | 134/2 |
| 2,961,356 | 11/1960 | Breese et al. | 134/28 |
| 3,066,050 | 11/1962 | Garton | 134/2 |
| 3,291,640 | 12/1966 | Livingston | 134/1 |
| 3,380,921 | 4/1968 | Goodspeed et al. | 252/95 |
| 3,506,487 | 4/1970 | Lenz et al. | 134/2 |
| 3,553,015 | 1/1971 | Dohogne | 134/2 |
| 3,573,100 | 3/1971 | Beer | 134/3 |
| 3,649,260 | 3/1972 | Denniston et al. | 75/211 |
| 3,690,949 | 9/1972 | Ng | 134/2 |
| 3,706,600 | 12/1972 | Pumphrey et al. | 134/3 |
| 3,728,155 | 4/1973 | Ford et al. | 134/3 |
| 3,778,309 | 12/1973 | Jackson | 134/2 |
| 3,898,351 | 8/1975 | Kennison et al. | 427/57 |
| 3,951,681 | 4/1976 | Shoemaker et al. | 134/2 |
| 4,126,483 | 11/1978 | Donakowski et al. | 134/3 |
| 4,188,237 | 2/1980 | Chasteen | 134/2 |
| 4,219,199 | 8/1980 | Okuda | 274/38 |
| 4,264,374 | 4/1981 | Beyer et al. | 134/3 |
| 4,275,100 | 6/1981 | Datta | 134/42 X |

*Primary Examiner*—Marc L. Caroff

*Attorney, Agent, or Firm*—Birgit E. Morris

[57] ABSTRACT

The surface of a diamond bonded to a shank is cleaned by subjecting the shanked diamond to an ultrasonically agitated aqueous bath, contacting the shanked diamond with a concentrated aqueous alkaline solution, contacting the shanked diamond with an aqueous hydrogen peroxide solution, contacting the shanked diamond with a dilute aqueous citric acid solution, contacting the shanked diamond with an aqueous hydrofluoric acid-nitric acid solution, and rinsing the shanked diamond with water.

13 Claims, No Drawings

SHANK DIAMOND CLEANING

This invention relates to a method of cleaning the surface of a diamond which is bonded to a shank.

BACKGROUND OF THE INVENTION

Diamond can be utilized as the dielectric support element in a capacitive information disc playback stylus. In order to decrease the cost of these playback styli, diamond bonded to shanks may be employed. A preferred shank material is titanium although other metals or materials such as plastic may be employed. Diamond may be bonded to the metal or other material by soldering, brazing, glueing or by any other method known to the art. A problem I have encountered in the cleaning of a diamond bonded to a titanium shank with a copper-silver braze occurs in the cleaning of the diamond surfaces. The diamond surfaces must be cleaned prior to deposition of a conductive metal layer.

Difficulties were encountered in cleaning because of the different chemistries of the shank, braze and diamond. The diamond surface must be cleaned of particles, metal such as iron and titanium, brazing materials, and other contaminants. The cleaning process must not damage the diamond, the shank material or the bond between the diamond and the shank. It is therefore required to have a method for cleaning a shanked diamond without adversely affecting the diamond, the shank, or the interface bonding the shank to the diamond.

SUMMARY OF THE INVENTION

I have found a method for cleaning the surface of a diamond which is bonded to a shank. The steps include first subjecting the shanked diamond to an ultrasonically agitated aqueous bath to remove particulates, then sequentially contacting the shanked diamond with a concentrated aqueous alkaline solution, next with an aqueous hydrogen peroxide solution, then with an aqueous citric acid solution, and lastly with an aqueous hydrofluoric acid-nitric acid solution.

DETAILED DESCRIPTION OF THE INVENTION

In order to remove particulates such as soil and loosely bound impurities, a first ultrasonically-agitated water bath may be employed. Generally, ultrasonic frequencies of between about 25 and 40 kilohertz (kHz) are suitable. A detergent may be advantageously employed in the water bath. It is preferred to employ a heated aqueous detergent solution, for example, at 80°-90° C. Generally, an agitation period of about 10 minutes is sufficient. The shanked diamonds are then rinsed in water to remove the aqueous detergent solution and any loosely adherent particulate matter. Repeated rinsing with deionized water has been found to be effective. Generally, the deionized water is heated to about 70° to 80° C. It is preferable to repeat the rinsing about 20 times in order to insure that all unwanted material has been removed.

A hot aqueous alkaline solution is then employed to remove organic contaminants. A 40-50 percent weight to volume solution of sodium hydroxide in water is preferred. The solution is kept at about 110° C. and remains in contact with the shanked diamonds at that temperature, preferably for about 10 minutes. A more dilute solution requires longer contact times or a higher temperature. A more concentrated solution may result in damage to the braze.

The shanked diamonds are then rinsed with water to remove the alkaline solution. Rinsing with deionized water is preferred.

The shanked diamonds are then contacted with an aqueous hydrogen peroxide solution, preferably a 30±10 percent volume to volume solution, typically for about 5 minutes. Generally, the solution is kept hot, for example, at about 85° C. The peroxide solution can be removed by rinsing with water, preferably deionized water. The peroxide solution removes a sludge which is formed from the alkaline solution cleaning step. If the peroxide solution is too concentrated, the braze may be attacked and oxidized. If the peroxide solution is too dilute, a longer contact time is needed or the solution may not be effective.

The shanked diamonds are then contacted with a dilute aqueous citric acid solution, for example, about 0.05 M. The purpose of the citric acid solution is to removal metal ions such as copper and iron cations. A hot citric acid solution is preferred, generally at about 60° C. The shanked diamond may be kept in contact with the hot citric acid solution for about 5 minutes. If the citric acid solution is too concentrated, for example, about 0.1 M, the braze may be etched. If the citric acid solution is too dilute, for example, about 0.01 M, either a longer contact time may be required or the solution will not be effective. The citric acid solution can be removed with water, preferably with deionized water.

An $HF-HNO_3$ aqueous solution is then contacted with the shanked diamond. The purpose of this acid solution is to remove titanium and its compound from the diamond surface. Generally, contact for about 10 to 15 seconds is sufficient using a solution made up of 10 parts HF, 1 part $HNO_3$ and 50 parts $H_2O$, all parts by volume. A short contact time is required in order to prevent serious damage to the titanium shank. If the solution is too concentrated, both the shank and braze will be attacked. If the solution is too dilute, the braze will be attacked, but titanium and its compounds may not be removed from the diamond surface. The contact time of the acid solution is determined in part by the silver content of the braze. Generally, the higher the silver content, the shorter the contact time, because of the enhanced sensitivity to the $HF-HNO_3$ solution. The acid solution is removed with a water rinse, preferably with deionized water.

All of the foregoing steps may be performed using any suitable container for the shanked diamonds, for example, a quartz vessel. For the following step a clean platinum basket is preferred. The shanked diamonds are rinsed with deionized water for about 3 minutes.

The shanked diamonds are preferably contacted with fresh deionized water using ultrasonic agitation at a frequency of about 25 kHz for two minutes. A suitable container is a quartz vessel. The deionized rinse followed by the deionized water ultrasonic agitation are preferably repeated twice. A final rinse with deionized water may then be carried out; 3 minutes has been found to be sufficient. The water flowing through the platinum basket and the ultrasonic agitation serve to remove any diamond particles which may have adhered to the diamond surface.

Finally, the shanked diamonds are dried. An infrared oven may be employed for drying.

Other methods of cleaning have been tried but have not been found to be useful because of the damage caused to the braze employed to bond the titanium shank to the diamond. For example, molten salts such as $NaOH+NaNO_3$ in a weight-to-weight ratio of 2 to 1 were employed at 400° C. for about 5 to 10 minutes. The brazed interface failed after this treatment.

A mixture of 1 part by weight of potassium dichromate and 3 parts by weight of phosphoric acid at 180° C. for 10 minutes also caused failure of the brazed interface.

In addition, an ethylene-diamine-tetraacetic acid (EDTA) titanium etch solution employed for 5 to 10 minutes also damaged the brazed bond. The etch solution was 2 parts by volume of a solution made from 4.85 grams of EDTA in 10 milliliters of 40 percent weight to volume ammonium hydroxide in water further diluted to 200 milliliters with deionized water; and one part of a 30 percent volume to volume hydrogen peroxide aqueous solution. The etch solution caused damage to the braze which loosened the diamond—titanium bond.

The present invention will be further illustrated by means of the following example. However, it is to be understood that the invention is not meant to be limited to the details described therein.

EXAMPLE

A titanium shank bonded to a diamond by means of a copper-silver braze was employed. About 200 to 300 shanked diamonds were placed in a 400 milliliter quartz beaker. Two hundred milliliters of a 0.02 weight to volume percent detergent solution in which MICRO (available from International Products Corp., Trenton, N.J.) in water was the solution employed. The solution was heated to 80°-90° C. and subjected to ultrasonic agitation at 25 kHz employing a Branson ultrasonic cleaner for 10 minutes. The shanked diamonds were then rinsed 20 times with deionized water at 70°-80° C.

A 40-50 percent weight-to-volume sodium hydroxide aqueous solution at 110° C. was added to the shanked diamonds and kept at that temperature in contact with the shanked diamonds for 10 minutes. The sodium hydroxide solution was removed and the shank diamonds were rinsed 20 times with 70°-80° C. deionized water.

A 30 percent volume-to-volume solution of hydrogen peroxide in water at 85° C. was added to the shanked diamonds. This temperature was maintained while the shanked diamonds contacts the solution for 5 minutes. The hydrogen peroxide solution was decanted and the shanked diamonds were rinsed 20 times with deionized water. A 0.05 M solution of citric acid in water was added to the shanked diamonds. The solution was heated to 60° C. and maintained at that temperature for 5 minutes. Following the decanting of the citric acid solution, the shanked diamonds were rinsed 20 times with deionized water.

A $HF-HNO_3-H_2O$ solution having a volume ratio of 10 to 1 to 50 was contacted with the shanked diamonds for 15 seconds. The acid solution was decanted and the shanked diamonds were rinsed 20 times with deionized water.

The shanked diamonds were transferred to a clean platinum basket having a volume of 50 milliliters. The shanked diamonds were rinsed with deionized water for 3 minutes. The shanked diamonds were then placed in a clean quartz beaker and using the same ultrasonic cleaning apparatus previously described, was ultrasonically agitated at a frequency of 25 kHz in fresh deionized water for 2 minutes. The deionized water rinse and ultrasonic agitation were repeated twice followed by a final rinse for 3 minutes in deionized water. The shanked diamonds were then dried in an infrared oven for 30 minutes.

The resulting shanked diamonds were free of all unwanted particulate and surface contamination, the diamond was still firmly bonded to the shank and could be readily metallized with an adherent titanium layer and shaped on an abrasive surface without the diamond loosening or the metal layer flaking off.

I claim:

1. A method for cleaning the surface of a diamond which is bonded to a shank comprising the steps of:

(a) subjecting the shanked diamond to an ultrasonically agitated aqueous bath, (b) contacting the shanked diamond with a concentrated aqueous alkaline solution, (c) contacting the shanked diamond with an aqueous hydrogen peroxide solution, (d) contacting the shanked diamond with dilute aqueous citric acid solution, (e) contacting the shanked diamond with an aqueous hydrofluoric acid-nitric acid solution, and (f) rinsing the shanked diamond with water.

2. A method in accordance with claim 1 wherein the shanked diamond is rinsed with water after each of steps (a)-(d).

3. A method in accordance with claims 1 or 2 wherein the water is deionized.

4. A method in accordance with claim 2 wherein the water employed for rinsing after steps (a) and (b) has a temperature of about 70°-80° C.

5. A method in accordance with claim 1 wherein the frequency of ultrasonic agitation in step (a) is between about 25 and 40 kilohertz.

6. A method in accordance with claim 1 wherein the solution of step (b) is an about 40-50 percent weight-to-volume sodium hydroxide aqueous solution.

7. A method in accordance with claim 6 wherein the sodium hydroxide aqueous solution has a temperature of about 110° C.

8. A method in accordance with claim 1 wherein the hydrogen peroxide solution of step (c) has a concentration of between about 20 and 40 percent by volume of hydrogen peroxide in water.

9. A method in accordance with claim 8 wherein the concentration is about 30 percent by volume.

10. A method in accordance with claim 1 wherein the hydrogen peroxide solution of step (c) has a temperature of about 85° C.

11. A method in accordance with claim 1 wherein the citric acid solution has a concentration of about 0.05 M.

12. A method in accordance with claim 1 wherein the citric acid solution has a temperature of 60° C.

13. A method in accordance with claim 1 wherein the volume ratio of $HF:HNO_3:H_2O$ in the solution of step (e) is 10:1:50.

* * * * *